US009340023B2

(12) United States Patent
Mikulan et al.

(10) Patent No.: US 9,340,023 B2
(45) Date of Patent: May 17, 2016

(54) METHODS OF MAKING INKJET PRINT HEADS USING A SACRIFICIAL SUBSTRATE LAYER

(71) Applicant: STMICROELECTRONICS, INC., Coppell, TX (US)

(72) Inventors: Paul I. Mikulan, Carrollton, TX (US); Kenneth J. Stewart, Coppell, TX (US); Virgina L. Hwang, Richardson, TX (US)

(73) Assignee: STMICROELECTRONICS, INC., Coppell, TX (US)

( * ) Notice: Subject to any disclaimer, the term of this patent is extended or adjusted under 35 U.S.C. 154(b) by 248 days.

(21) Appl. No.: 13/906,447

(22) Filed: May 31, 2013

(65) Prior Publication Data

US 2014/0356990 A1 Dec. 4, 2014

(51) Int. Cl.
*B41J 2/16* (2006.01)

(52) U.S. Cl.
CPC ..... *B41J 2/1603* (2013.01); *B41J 2/1601* (2013.01); *B41J 2/1628* (2013.01); *B41J 2/1629* (2013.01); *B41J 2/1631* (2013.01); *B41J 2/1635* (2013.01); *B41J 2/1637* (2013.01); *B41J 2/1639* (2013.01); *Y10T 29/49083* (2015.01); *Y10T 29/49087* (2015.01); *Y10T 29/49401* (2015.01)

(58) Field of Classification Search
CPC .... B41J 2/14112; B41J 2/14129; B41J 2/145; B41J 2/1601; B41J 2/1603; B41J 2/1632; B41J 2/1635; B41J 2002/14491; B41J 2/1628; B41J 2/1629; B41J 2/1631; B41J 2/1639; B41J 2/1637; B28D 5/022; B28D 5/027; Y10T 29/42; Y10T 29/49083; Y10T 29/49401; Y10T 29/49798; Y10T 29/49087
See application file for complete search history.

(56) References Cited

U.S. PATENT DOCUMENTS

| | | | | |
|---|---|---|---|---|
| 4,250,603 | A * | 2/1981 | Luft | Y10T 29/42 |
| 5,000,811 | A * | 3/1991 | Campanelli | B41J 2/145 |
| 6,234,608 | B1 * | 5/2001 | Genovese et al. | B41J 2/1635 |
| 6,787,051 | B2 | 9/2004 | Silverbrook | |
| 6,866,789 | B1 | 3/2005 | Silverbrook | |
| 7,266,868 | B2 * | 9/2007 | Sugahara | B41J 2/1637 29/25.35 |
| 7,758,155 | B2 | 7/2010 | Anagnostopoulos | |
| 7,966,728 | B2 | 6/2011 | Bushwell | |
| 8,173,030 | B2 | 5/2012 | Lebens et al. | |
| 2007/0212890 | A1 * | 9/2007 | Sakai et al. | B41J 2/1639 |
| 2007/0240309 | A1 * | 10/2007 | Buswell et al. | B41J 2/1632 |
| 2012/0293587 | A1 | 11/2012 | Bakker et al. | |

FOREIGN PATENT DOCUMENTS

| | | | |
|---|---|---|---|
| JP | 2007144992 A | * | 6/2007 |
| JP | 2008213336 A | * | 9/2008 |

* cited by examiner

*Primary Examiner* — A. Dexter Tugbang
(74) *Attorney, Agent, or Firm* — Allen, Dyer, Doppelt, Milbrath & Gilchrist, P.A.

(57) ABSTRACT

A method of making inkjet print heads may include forming a first wafer including a sacrificial substrate layer, and a first dielectric layer thereon having first openings therein defining inkjet orifices. The method may also include forming a second wafer having inkjet chambers defined thereon, and joining the first and second wafers together so that each inkjet orifice is aligned with a respective inkjet chamber. The method may further include removing the sacrificial substrate layer thereby defining the inkjet print heads.

20 Claims, 9 Drawing Sheets

METHODS OF MAKING INKJET PRINT HEADS USING A SACRIFICIAL SUBSTRATE LAYER

FIELD OF THE INVENTION

The present invention relates to inkjet printers, and more particularly, to methods of making inkjet print heads.

BACKGROUND OF THE INVENTION

Modern ink jet printers may produce photographic-quality images. An inkjet printer includes a number of orifices or nozzles spatially positioned in a printer cartridge. Ink is heated when an electrical pulse energizes a resistive element forming a thermal resistor. The ink resting above the thermal resistor is ejected through the orifice towards a printing medium, such as an underlying sheet of paper as a result of the applied electrical pulse.

The thermal resistor is typically formed as a thin film resistive material on a semiconductor substrate as part of a semiconductor chip, for example. Several thin film layers may be formed on the semiconductor chip, including a dielectric layer carried by the substrate, a resistive layer forming the thermal resistor, and an electrode layer that defines electrodes coupled to the resistive layer to which the pulse is applied to heat the thermal resistor and vaporize the ink.

An orifice plate is typically placed onto the print head die stack or the layers described above, for example, by a pick-and-place technique. The orifice plate is typically a metallic or a polymeric material. By using a metallic or polymeric orifice plate, increased consideration of the thermal budget of the inkjet circuitry, for example, may be given. Moreover, formation of desired dimensions, for example, thickness and shape and size, of the orifice may be less controlled, thus resulting in less reliable and less accurate print heads.

SUMMARY

A method of making a plurality of inkjet print heads may include forming a first wafer comprising a sacrificial substrate layer, and a first dielectric layer thereon having a plurality of first openings therein defining a plurality of inkjet orifices. The method may also include forming a second wafer having a plurality of inkjet chambers defined thereon, and joining the first and second wafers together so that each inkjet orifice is aligned with a respective inkjet chamber. The method may also include removing the sacrificial substrate layer thereby defining a plurality of inkjet print heads. Accordingly, the inkjet print heads may be made more efficiently, and, for example, more accurately with respect to orifice size, and overall thickness, and desired thermal properties.

The method may further include dividing the joined-together first and second wafers into a plurality of individual inkjet print heads prior to removing the sacrificial substrate layer, for example. In other embodiments, the method may include dividing the joined-together first and second wafers into a plurality of individual inkjet print heads after removing the sacrificial substrate layer.

Forming the second wafer may include forming a second dielectric layer on a second substrate layer with the second dielectric layer having a plurality of second openings therein defining, with adjacent portions of the second substrate layer, the plurality of inkjet chambers. Forming the second wafer may further include forming a plurality of ink heaters, with each ink heater within a respective inkjet chamber and forming control circuitry on the second substrate layer and coupled to the plurality of ink heaters.

Forming the second wafer may also further include forming a plurality of microfluidic passageways through the second substrate layer with each microfluidic passageway in communication with a respective inkjet chamber. Removing the sacrificial substrate layer and forming the plurality of microfluidic passageways may be performed in a common etching operation, for example.

Removing the sacrificial substrate layer may include removing the sacrificial substrate layer by at least one of wet etching and reactive ion etching, for example. The first dielectric layer may include an oxide layer, and the sacrificial substrate layer may include silicon, for example.

DETAILED DESCRIPTION

The embodiments will now be described more fully hereinafter with reference to the accompanying drawings, in which preferred embodiments are shown. The embodiments may, however, be in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime and multiple prime notation is used to describe like elements in different embodiments.

Figure 1:
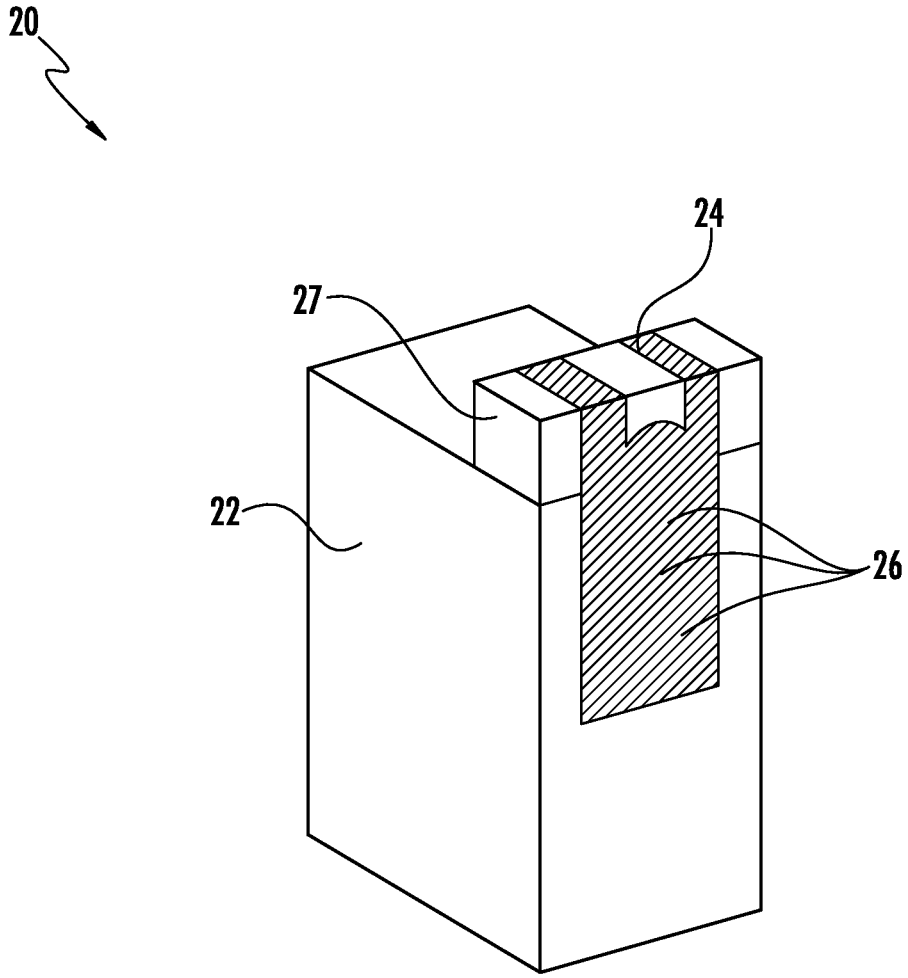
FIG. 1 is a perspective view of an inkjet print head cartridge that incorporates an inkjet print head made according to a method embodiment.

Referring initially to FIG. 1, an inkjet print head cartridge 20 is now described. This inkjet print cartridge 20 includes a cartridge body 22 that includes ink, for example, for an inkjet print head. The ink is channeled into a plurality of inkjet chambers, each associated with a respective orifice 24 or print head nozzle positioned on the body 22 and configured to eject ink onto the paper or other print media. Electrical signals are provided to conductive traces 26 to energize thermal resistors that heat the ink and eject a droplet of ink through an associated orifice 24.

The orifices 24 are typically located at an inkjet print head 27 of the print head cartridge 20. In an example, the print head cartridge 20 may include 300 or more orifices 24, each orifice 24 having an associated inkjet chamber 30, as will be appreciated by those skilled in the art. During manufacture, many print heads 27 may be formed on a single silicon wafer and separated. Such methods of making inkjet print heads are described in further detail below.

Figure 2:
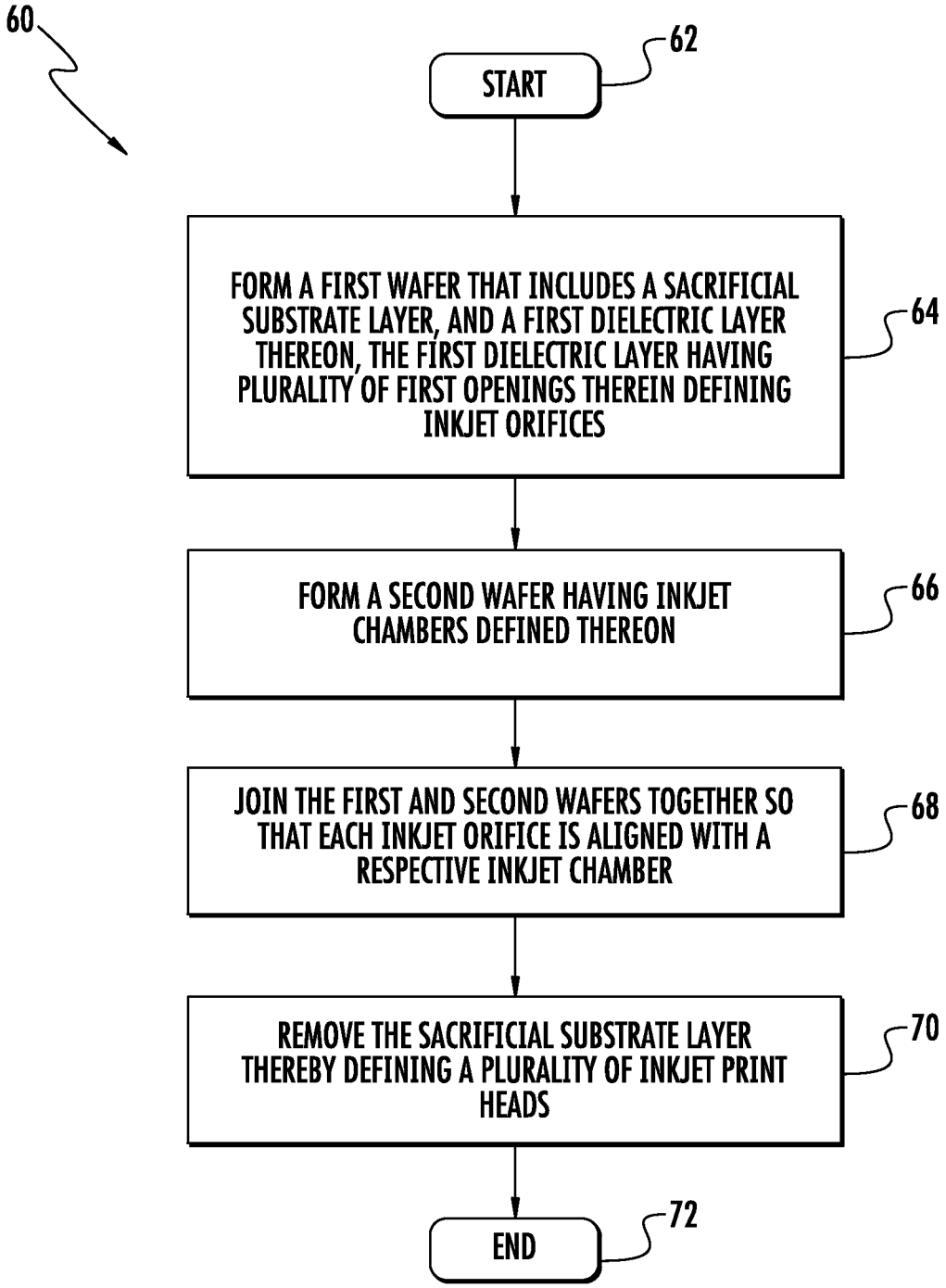
FIG. 2 is a flowchart of a method of making inkjet print heads in accordance with an embodiment.
Figure 3:
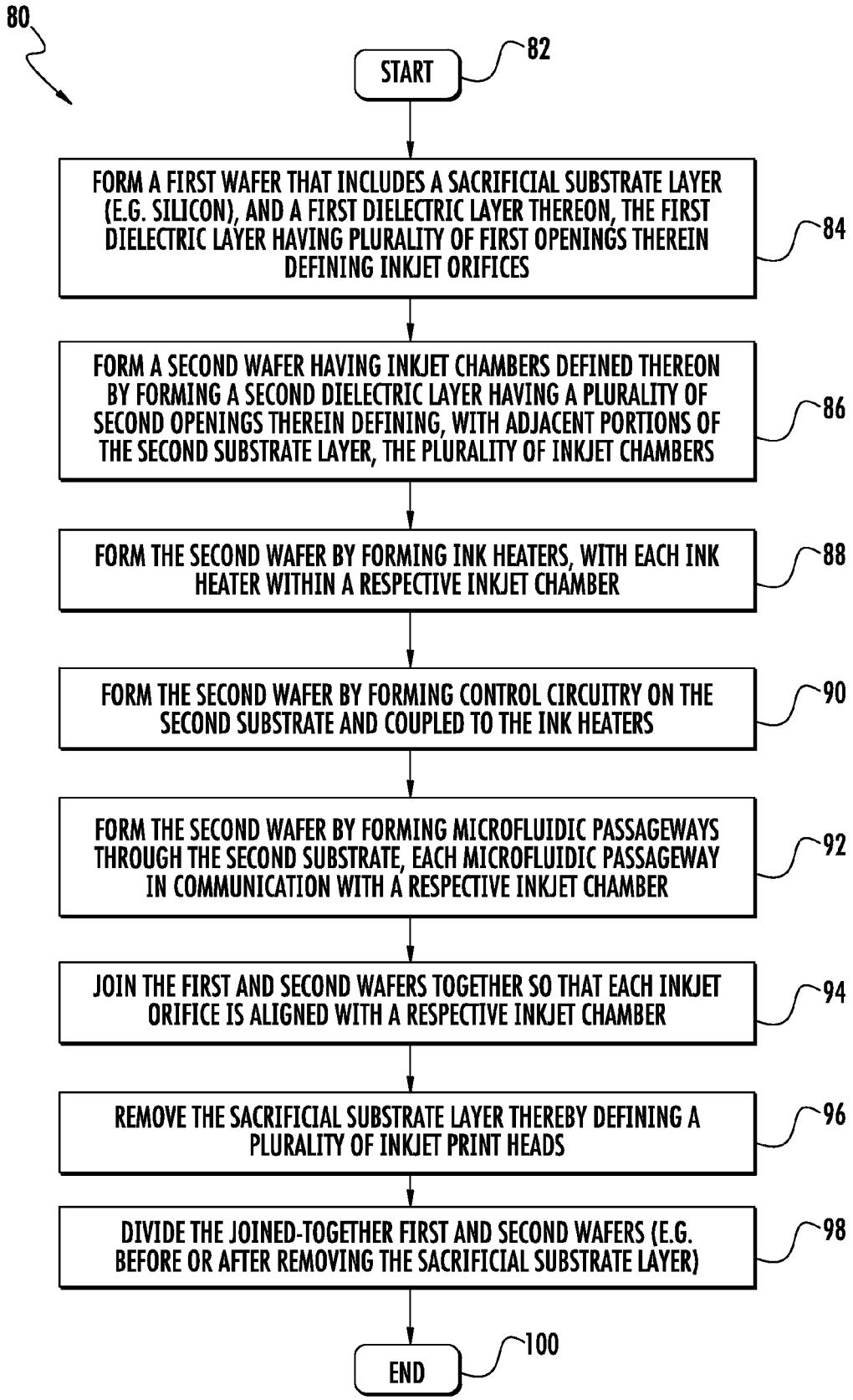
FIG. 3 is a flowchart of a more detailed method of making inkjet print heads in accordance with an embodiment.

Referring now to the flowchart 60 in FIG. 2, a method of making inkjet print heads is described. Beginning at Block 62, the method includes forming a first wafer that includes a sacrificial substrate layer, and a first dielectric layer thereon (Block 64). The first dielectric layer has a plurality of first openings therein defining inkjet orifices. The method includes also includes, at Block 66, forming a second wafer having inkjet chambers defined thereon.

At Block 68, the method includes joining the first and second wafers together so that each inkjet orifice is aligned with a respective inkjet chamber. At Block 70 the method includes removing the sacrificial substrate layer thereby defining a plurality of inkjet print heads. The method ends at Block 72.

Referring now to the flowchart 80 in FIG. 3 and FIGS. 4*a*-4*c*, a more detailed method of making inkjet print heads 27 is now described. It should be noted that while reference is made to multiple orifices and inkjet chambers, for ease of understanding, a single orifice and inkjet chamber are illustrated.

Figure 4A:
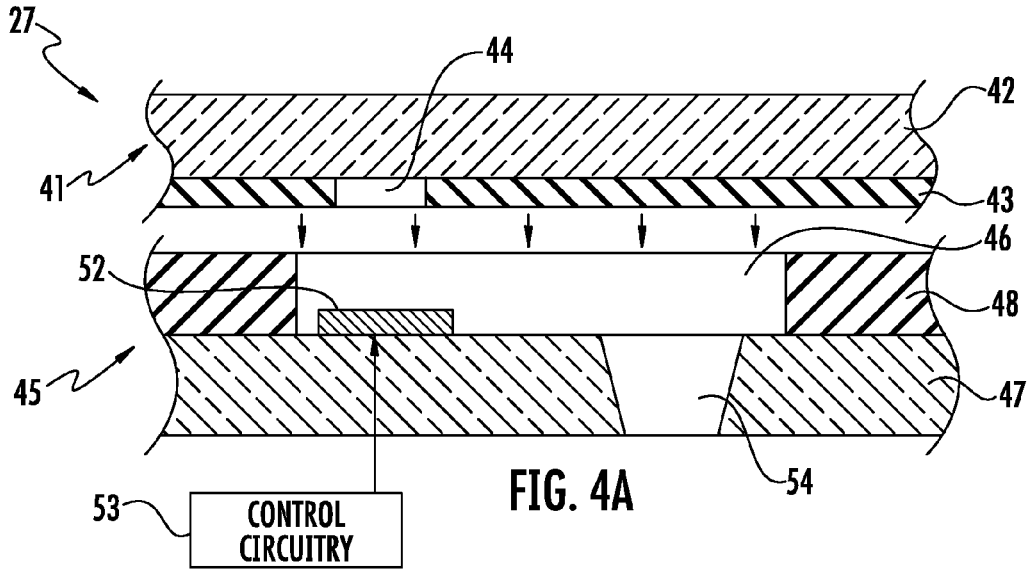
FIG. 4*a* is a schematic cross-sectional view of first and second wafers made according to the method of FIG. 3.

Beginning at Block 82, the method includes forming a first wafer 41 that includes a sacrificial substrate layer 42, and a first dielectric layer 43 thereon (Block 84) (FIG. 4*a*). The first dielectric layer 43 has a plurality of first openings therein defining inkjet orifices 44. The first dielectric layer 43 may be an oxide layer, for example, that may be grown or deposited on the sacrificial substrate layer 42. By growing or depositing the first dielectric layer 43, it may be easier to achieve a desired thickness, desired thermal properties, desired target surface, and desired stress, for example, with respect to a prior art metallic or polymeric first dielectric layer. The sacrificial substrate layer 42 may be silicon, for example. As will be appreciated by those skilled in the art, less expensive silicon may be used for the sacrificial substrate layer 42 to reduce costs (e.g., a non-IC quality sacrificial silicon substrate layer).

The method includes also includes forming a second wafer 45 having inkjet chambers 46 defined thereon on a second substrate layer 47 by forming a second dielectric layer 48 having second openings therein 51 defining, with adjacent portions of the second substrate layer, the inkjet chambers 46 (Block 86). The second dielectric layer 48 may be a polymeric or an inorganic dielectric material as will be appreciated by those skilled in the art.

At Block 88, the second wafer 45 is further formed by forming ink heaters 52, with each ink heater within a respective inkjet chamber 46. The second wafer 45 is further formed by forming control circuitry 53 on the second substrate layer 47 and coupled to the ink heaters 52 (Block 90).

The second wafer 45 is further formed by forming microfluidic passageways 54 through the second substrate layer 47 (Block 92). Each microfluidic passageway 54 is in communication with a respective inkjet chamber 46.

Figure 4B:
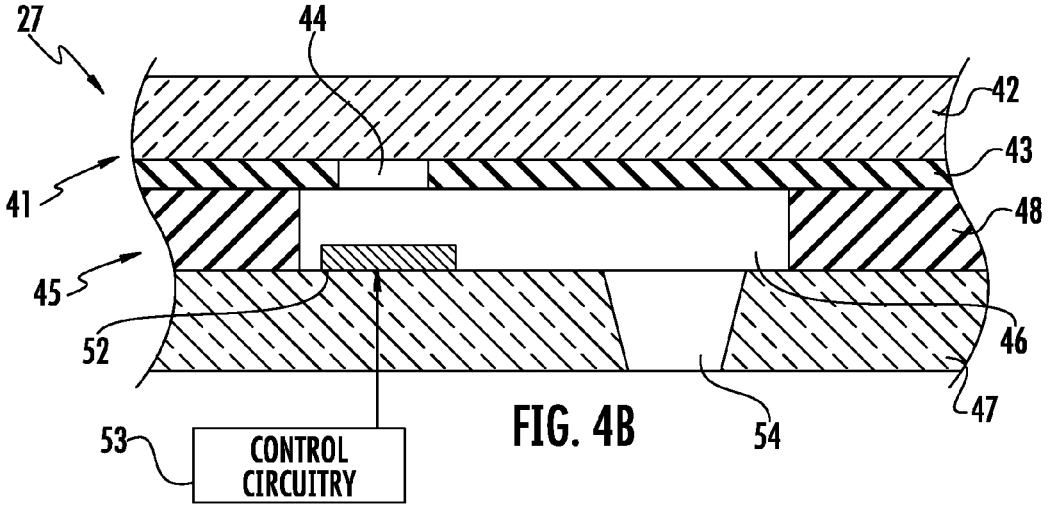
FIG. 4*b* is a schematic cross-sectional view of joined-together first and second wafers made according to the method of FIG. 3.

At Block 94, the method includes joining the first and second wafers 41, 45 together so that each inkjet orifice 44 is aligned with a respective inkjet chamber 46 (FIG. 4*b*). More particularly, the first and second wafers 41, 45 may be aligned so that each ink heater 52 is aligned with each inkjet orifice 44, for example, underneath or aligned with an axis through the orifice. The first and second wafers 41, 45 may be joined together using techniques that will be appreciated by those skilled in the art.

Figure 4C:
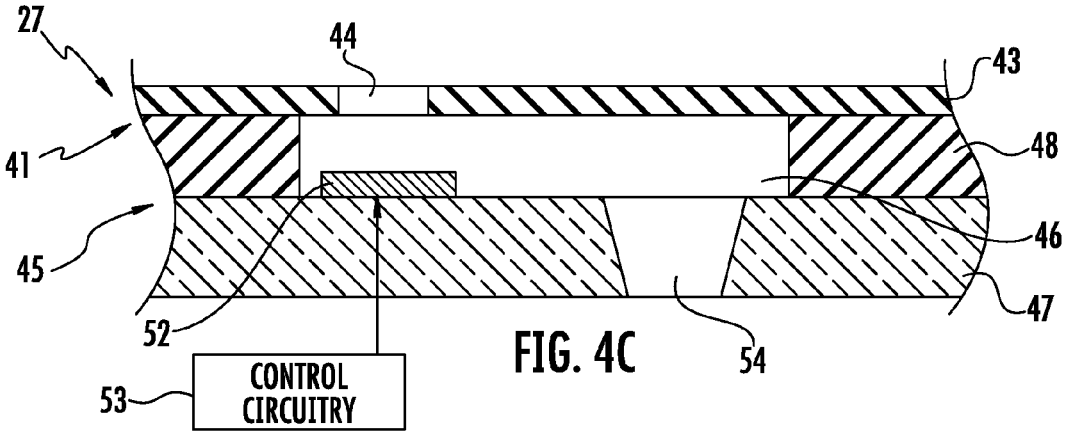
FIG. 4*c* is a schematic cross-sectional view of joined-together first and second wafers after removing the sacrificial substrate layer in accordance the method of FIG. 3.

At Block 96, the method includes removing the sacrificial substrate layer 42 thereby defining inkjet print heads 27 (FIG. 4*c*). In some embodiments, the sacrificial substrate layer 42 may be removed by wet etching. As will be appreciated by those skilled in the art, wet etching may be more cost effective, but may be less accurate when defining angles for the microfluidic passageways 54, for example. Alternatively, the sacrificial substrate layer 42 may be removed by reactive ion etching (i.e., dry etching). Of course, other etching techniques may be used.

At Block 98, the joined-together first and second wafers 41, 45 are divided into individual print heads. In some embodiments, the joined-together first and second wafers 41, 45 may be divided prior to removing the sacrificial substrate layer 42. The method ends at Block 100.

Figure 5:
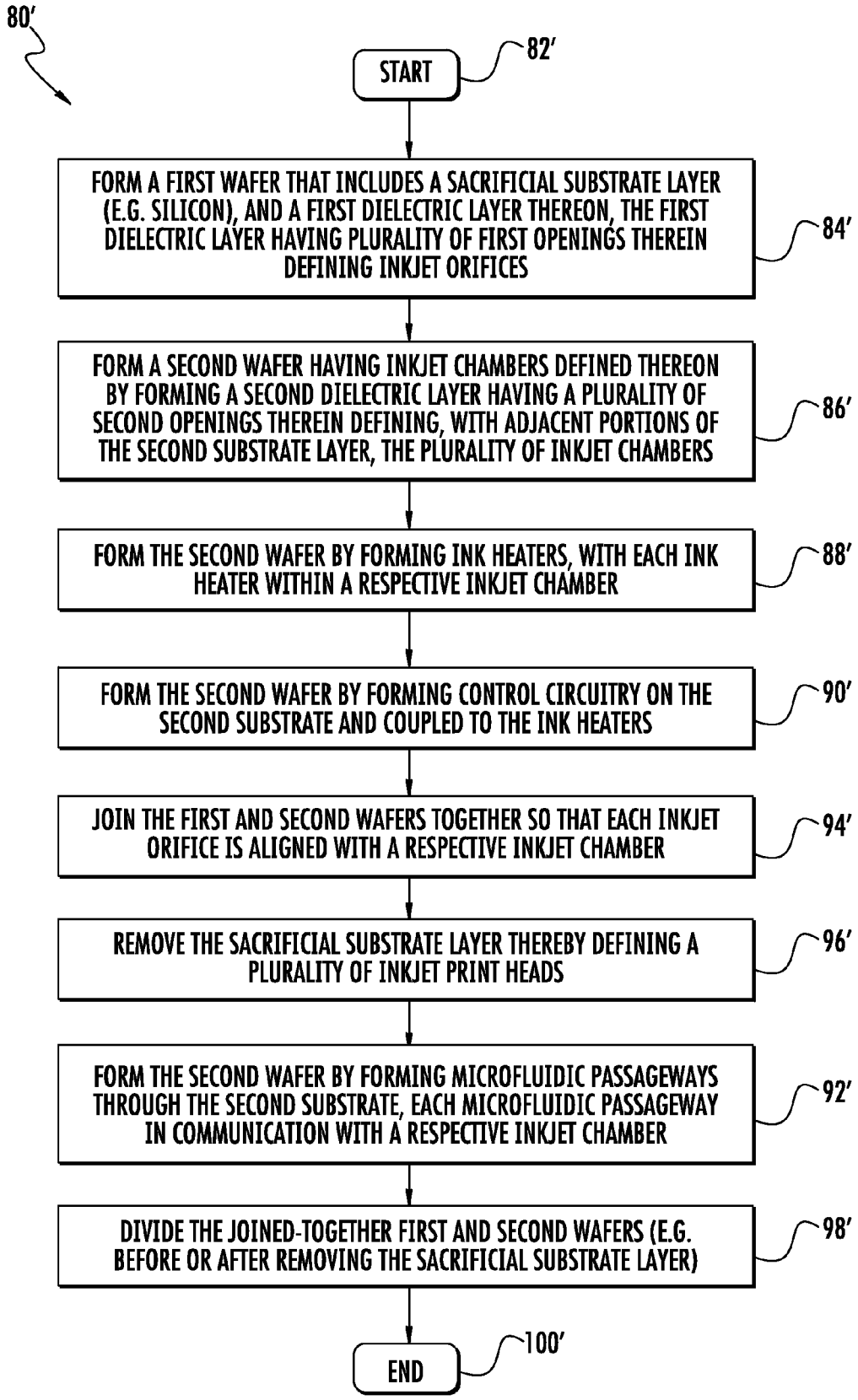
FIG. 5 is a flowchart of a method of making inkjet print heads in accordance with another embodiment.
Figure 6A:
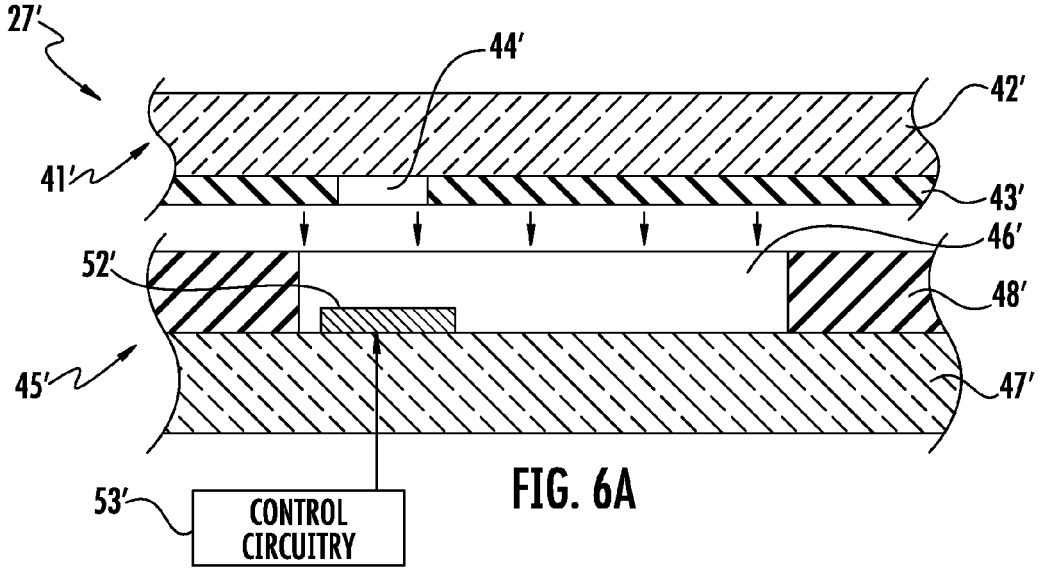
FIG. 6*a* is a schematic cross-sectional view of first and second wafers made according to the method of FIG. 5.
Figure 6B:
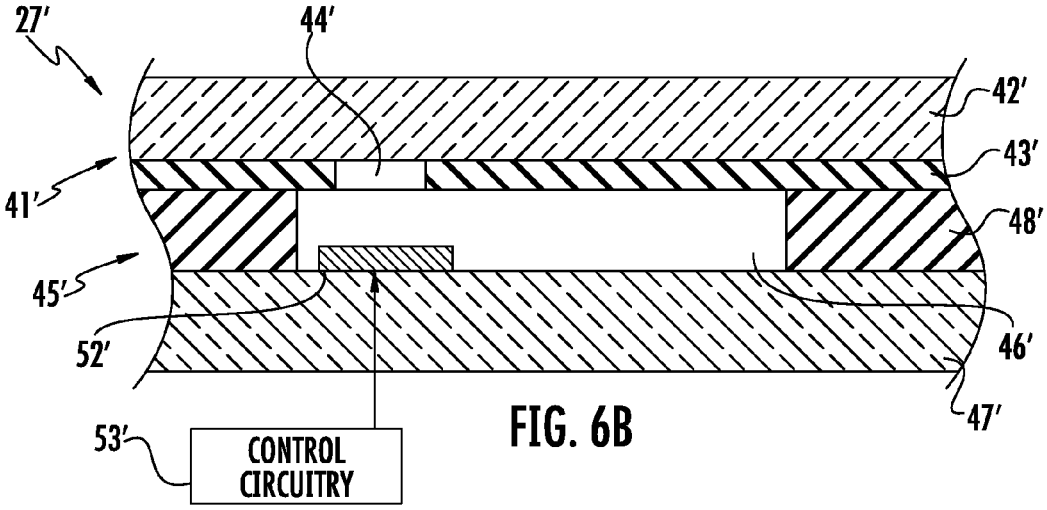
FIG. 6*b* is a schematic cross-sectional view of joined-together first and second wafers made according to the method of FIG. 5.
Figure 6C:
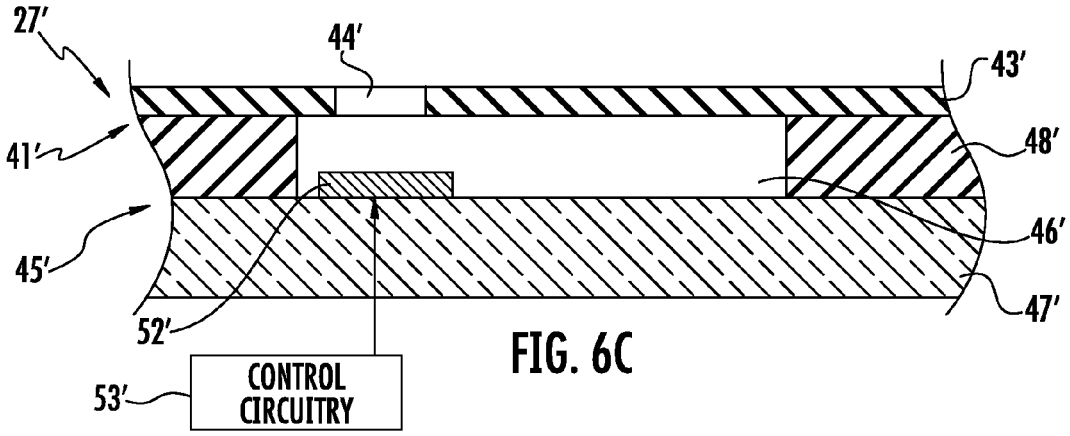
FIG. 6*c* is a schematic cross-sectional view of joined-together first and second wafers after removing the sacrificial substrate layer in accordance the method of FIG. 5.
Figure 6D:
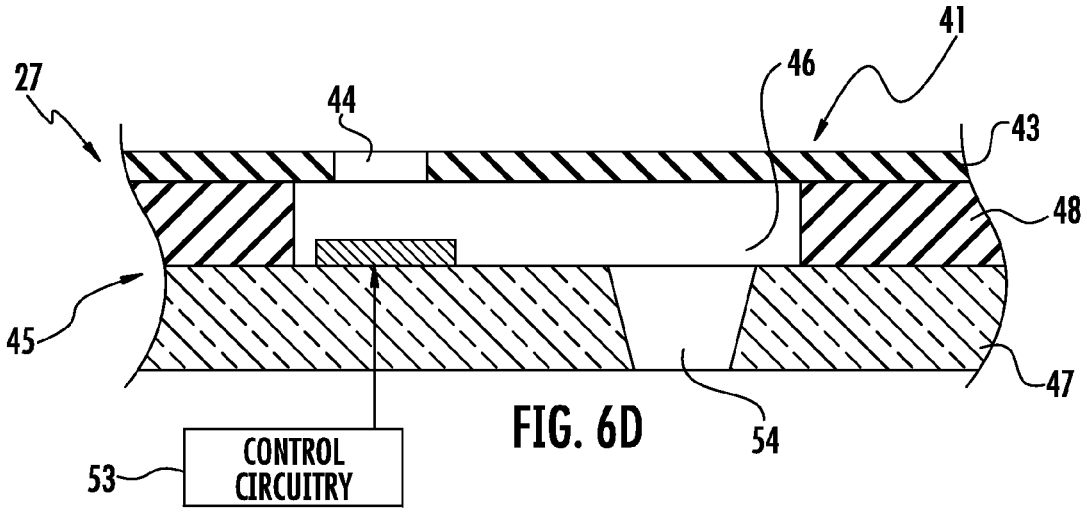
FIG. 6*d* is a schematic cross-sectional view of joined-together first and second wafers after forming microfluidic passageways in accordance with the method of FIG. 5.

Referring now to the flowchart 80' in FIG. 5, and FIGS. 6*a*-6*d*, in another embodiment, the microfluidic passageways 54' may be formed after the sacrificial substrate layer 42' is removed (Block 92'), as illustrated more particularly in FIG. 6*d*. The other method steps illustrated in the flowchart 80' in FIG. 5 are similar to the method steps described above with respect to FIG. 3.

Figure 7:
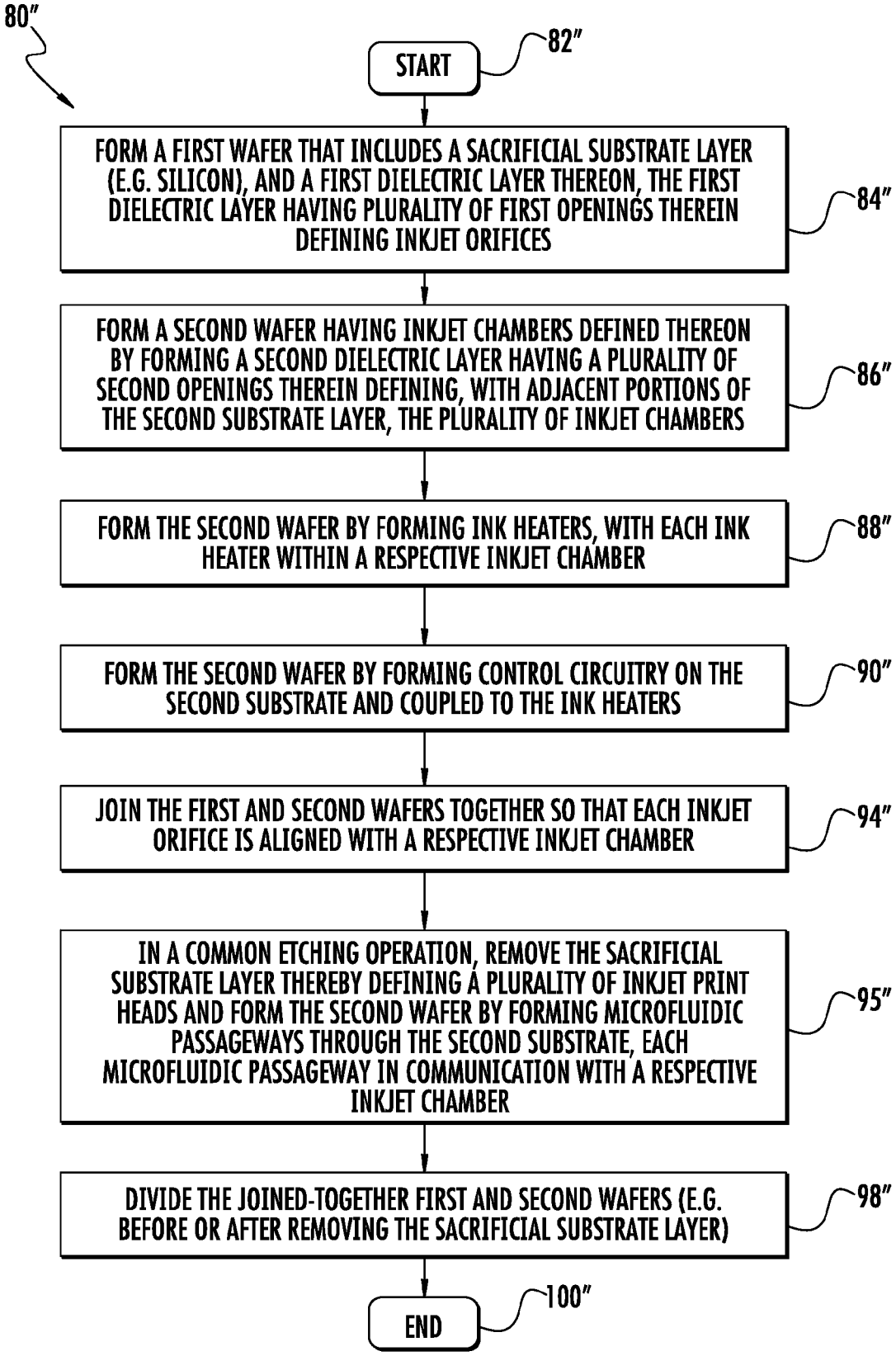
FIG. 7 is a flowchart of a method of making inkjet print heads in accordance with yet another embodiment.
Figure 8A:
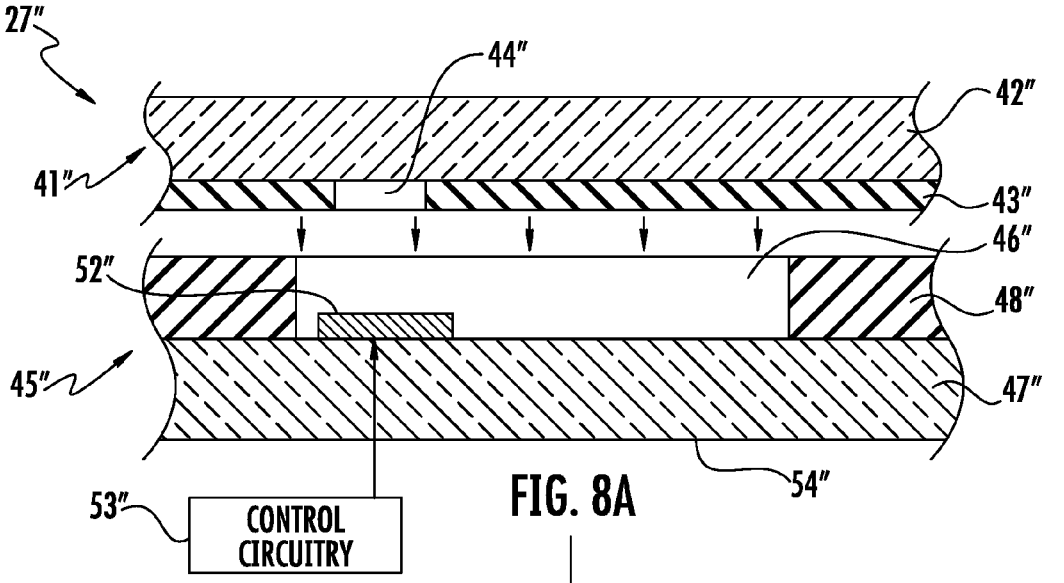
FIG. 8*a* is a schematic cross-sectional view of first and second wafers made according to the method of FIG. 7.
Figure 8B:
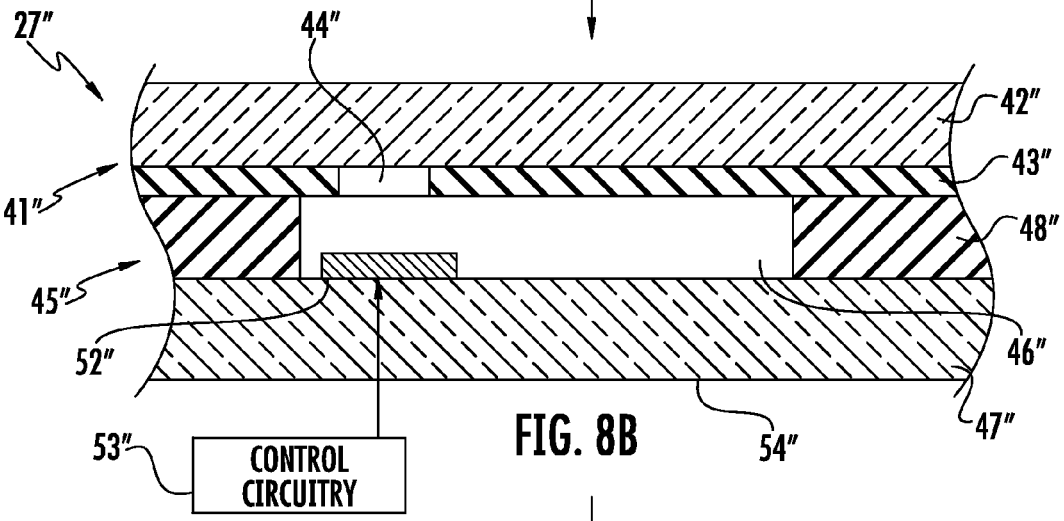
FIG. 8*b* is a schematic cross-sectional view of joined-together first and second wafers made according to the method of FIG. 7.
Figure 8C:
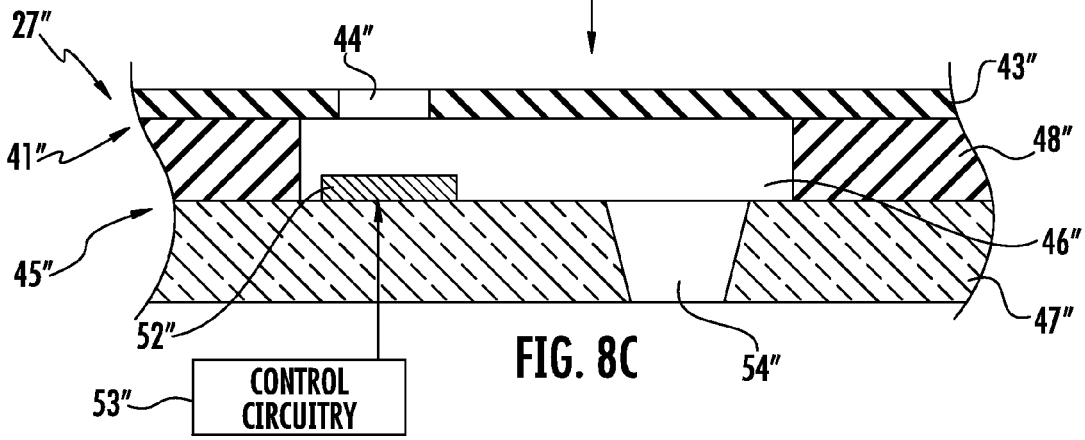
FIG. 8*c* is a schematic cross-sectional view of joined-together first and second wafers after removing the sacrificial substrate layer in accordance the method of FIG. 7.

Referring now to the flowchart 80" in FIG. 7, and FIGS. 8*a*-8*c*, in yet another embodiment, the sacrificial substrate layer 42" may be removed and the microfluidic passageways 54" may be formed in a common etching operation (Block 95"), for example, at a same time, as illustrated more particularly in FIG. 8*c*. The other method steps illustrated in the flowchart 80" in FIG. 7 are similar to the method steps described above with respect to FIG. 3.

As will be appreciated by those skilled in the art, the method described herein, at the wafer level, avoids the pick and place process of placing the first dielectric layer or orifice plate onto a print head die as in the prior art. Moreover, a typical orifice plate according to the prior art, may be metallic or polymeric. A metallic or polymeric orifice plate may be relatively thick, thus limiting the shape or slope or diameter of the orifice. By forming the first wafer 41 to include a first dielectric layer, for example, an oxide layer, the first dielectric layer may be thinner, and may be more compatible with other materials, and may thus result in a more durable print head. Also, an oxide first dielectric layer may provide increased flexibility in forming a desired shape of the orifice.

Many modifications and other embodiments will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A method of making a plurality of inkjet print heads comprising:

forming a first wafer comprising a sacrificial substrate layer, and a first dielectric layer thereon having a plurality of first openings therein defining a plurality of inkjet orifices;

forming a second wafer having a plurality of inkjet chambers defined thereon, the second wafer being formed physically independent of the first wafer;

joining the first and second wafers together, by bringing together the physically independently formed first and second wafers, so that each inkjet orifice is aligned with a respective inkjet chamber; and removing the sacrificial substrate layer thereby defining a plurality of inkjet print heads.

2. The method of claim 1, further comprising dividing the joined-together first and second wafers into a plurality of individual inkjet print heads prior to removing the sacrificial substrate layer.

3. The method of claim 1, further comprising dividing the joined-together first and second wafers into a plurality of individual inkjet print heads after removing the sacrificial substrate layer.

4. The method of claim 1, wherein forming the second wafer comprises forming a second dielectric layer on a second substrate layer with the second dielectric layer having a plurality of second openings therein defining, with adjacent portions of the second substrate layer, the plurality of inkjet chambers.

5. The method of claim 4, wherein forming the second wafer further comprises:

forming a plurality of ink heaters, with each ink heater within a respective inkjet chamber; and forming control circuitry on the second substrate layer and coupled to the plurality of ink heaters.

6. The method of claim 4, wherein forming the second wafer further comprises forming a plurality of microfluidic passageways through the second substrate layer with each microfluidic passageway in communication with a respective inkjet chamber.

7. The method of claim 6, wherein removing the sacrificial substrate layer and forming the plurality of microfluidic passageways is performed in a common etching operation.

8. The method of claim 1, wherein removing the sacrificial substrate layer comprises removing the sacrificial substrate layer by at least one of wet etching and reactive ion etching.

9. The method of claim 1, wherein the first dielectric layer comprises an oxide layer, and the sacrificial substrate layer comprises silicon.

10. A method of making a plurality of inkjet print heads from first and second wafers; the first wafer comprising a sacrificial substrate layer, and a first dielectric layer thereon having a plurality of first openings therein defining a plurality of inkjet orifices; and the second wafer having a plurality of inkjet chambers defined thereon; the first and second wafers being physically separated; the method comprising:

joining the first and second wafers together, by bringing together the physically separated first and second wafers, so that each inkjet orifice is aligned with a respective inkjet chamber; and removing the sacrificial substrate layer thereby defining a plurality of inkjet print heads.

11. The method of claim 10, further comprising dividing the joined-together first and second wafers into a plurality of individual inkjet print heads prior to removing the sacrificial substrate layer.

12. The method of claim 10, further comprising dividing the joined-together first and second wafers into a plurality of individual inkjet print heads after removing the sacrificial substrate layer.

13. The method of claim 10, wherein removing the sacrificial substrate layer comprises removing the sacrificial substrate layer by at least one of wet etching and reactive ion etching.

14. The method of claim 10, wherein the first dielectric layer comprises an oxide layer, and the sacrificial substrate layer comprises silicon.

15. A method of making a plurality of inkjet print heads comprising:

forming a first wafer comprising a sacrificial substrate layer, and a first dielectric layer thereon having a plurality of first openings therein defining a plurality of inkjet orifices;

forming a second wafer having a plurality of inkjet chambers defined thereon, the second wafer being formed physically independent of the first wafer;

joining the first and second wafers together, by bringing together the physically independently formed first and second wafers, so that each inkjet orifice is aligned with a respective inkjet chamber;

removing the sacrificial substrate layer by wet etching; and dividing the joined-together first and second wafers into the plurality of inkjet print heads.

16. The method of claim 15, wherein forming the second wafer comprises forming a second dielectric layer on a second substrate layer with the second dielectric layer having a plurality of second openings therein defining, with adjacent portions of the second substrate layer, the plurality of inkjet chambers.

17. The method of claim 16, wherein forming the second wafer further comprises:

forming a plurality of ink heaters, with each ink heater within a respective inkjet chamber; and forming control circuitry on the second substrate layer and coupled to the plurality of ink heaters.

18. The method of claim 16, wherein forming the second wafer further comprises forming a plurality of microfluidic passageways through the second substrate layer with each microfluidic passageway in communication with a respective inkjet chamber.

19. The method of claim 18, wherein removing the sacrificial substrate layer and forming the plurality of microfluidic passageways is performed in a common etching operation.

20. The method of claim 15, wherein the first dielectric layer comprises an oxide layer, and the sacrificial substrate layer comprises silicon.

* * * * *